US010598414B2

(12) United States Patent
Madsen et al.

(10) Patent No.: US 10,598,414 B2
(45) Date of Patent: Mar. 24, 2020

(54) METHOD FOR CONTROLLING A VARIABLE CAPACITY EJECTOR UNIT

(71) Applicant: DANFOSS A/S, Nordborg (DK)

(72) Inventors: Kenneth Bank Madsen, Ry (DK); Jan Prins, Nordborg (DK); Kristian Fredslund, Haderslev (DK)

(73) Assignee: DANFOSS A/S, Nordborg (DK)

( * ) Notice: Subject to any disclaimer, the term of this patent is extended or adjusted under 35 U.S.C. 154(b) by 144 days.

(21) Appl. No.: 15/503,761

(22) PCT Filed: Jun. 23, 2015

(86) PCT No.: PCT/EP2015/064019

§ 371 (c)(1),
(2) Date: Feb. 14, 2017

(87) PCT Pub. No.: WO2016/034298

PCT Pub. Date: Mar. 10, 2016

(65) Prior Publication Data

US 2017/0261245 A1 Sep. 14, 2017

(30) Foreign Application Priority Data

Sep. 5, 2014 (DK) ..... 2014 00502

(51) Int. Cl.
*F25B 41/00* (2006.01)
*F25B 41/04* (2006.01)

(52) U.S. Cl.
CPC ..... *F25B 41/00* (2013.01); *F25B 41/04* (2013.01); *F25B 2341/0012* (2013.01);
(Continued)

(58) Field of Classification Search
CPC .. F25B 41/00; F25B 41/04; F25B 2341/0012; F25B 2341/0013; F25B 2341/0015;
(Continued)

(56) References Cited

U.S. PATENT DOCUMENTS

2004/0040340 A1 3/2004 Takeuchi et al.
2004/0055326 A1 3/2004 Ikegami et al.
(Continued)

FOREIGN PATENT DOCUMENTS

CN 1374491 A 10/2002
CN 1776324 A 5/2006
(Continued)

OTHER PUBLICATIONS

Foreign translation for JP2010151424.*
Foreign translation for FR 2844036.*
International Search Report for PCT Serial No. PCT/EP2015/064019 dated Oct. 1, 2015.

*Primary Examiner* — Joseph F Trpisovsky
(74) *Attorney, Agent, or Firm* — McCormick, Paulding & Huber PLLC

(57) ABSTRACT

A method for controlling a variable capacity ejector unit (7) arranged in a refrigeration system (1) is disclosed. An ejector control signal for the ejector unit (7) is generated, based on an obtained temperature and an obtained pressure of refrigerant leaving a heat rejecting heat exchanger (3), or on the basis of a high pressure valve control signal for controlling an opening degree of a high pressure valve (6) arranged fluidly in parallel with the ejector unit (7). The ejector control signal indicates whether the capacity of the ejector unit (7) should be increased, decreased or maintained. The capacity of the ejector unit (7) is controlled in accordance with the generated ejector control signal. The power consumption of the refrigeration system (1) is reduced, while the pressure of the refrigerant leaving the heat rejecting heat exchanger (3) is maintained at an acceptable level.

13 Claims, 2 Drawing Sheets

(52) U.S. Cl.
CPC ..... *F25B 2341/0013* (2013.01); *F25B 2341/0015* (2013.01); *F25B 2600/17* (2013.01); *F25B 2600/2503* (2013.01); *F25B 2700/195* (2013.01); *F25B 2700/21163* (2013.01)

(58) Field of Classification Search
CPC ..... F25B 2341/00; F25B 2341/001; F25B 2600/17; F25B 2600/2503; F25B 2700/195; F25B 2400/0407
USPC ..... 62/117
See application file for complete search history.

(56) References Cited

U.S. PATENT DOCUMENTS

| | | | | |
|---|---|---|---|---|
| 2011/0023515 | A1* | 2/2011 | Kopko ..... | F28D 21/0017 62/222 |
| 2012/0167601 | A1 | 7/2012 | Cogswell et al. | |

FOREIGN PATENT DOCUMENTS

| | | | |
|---|---|---|---|
| CN | 101922823 | A | 12/2010 |
| FR | 2 844 036 | A1 | 3/2004 |
| FR | 2844036 | * | 10/2005 |
| JP | 2010151424 | * | 7/2010 |
| RU | 2415307 | C1 | 3/2011 |
| WO | 2012/012493 | A2 | 1/2012 |

* cited by examiner

METHOD FOR CONTROLLING A VARIABLE CAPACITY EJECTOR UNIT

CROSS-REFERENCE TO RELATED APPLICATIONS

This application is a National Stage application of International Patent Application No. PCT/EP2015/064019, filed on Jun. 23, 2015, which claims priority to Danish Patent Application No. PA201400502, filed on Sep. 5, 2014, each of which is hereby incorporated by reference in its entirety.

TECHNICAL FIELD

The present invention relates to a method for controlling an ejector unit having a variable capacity, the ejector unit being arranged in a refrigeration system. The method of the invention allows a low power consumption of the refrigeration system, while allowing a pressure in a high pressure part of the refrigeration system to be maintained at a desired level.

BACKGROUND

Refrigeration systems normally comprise a compressor, a heat rejecting heat exchanger, e.g. in the form of a condenser or a gas cooler, an expansion device, e.g. in the form of an expansion valve, and an evaporator arranged in a refrigerant path. Refrigerant flowing in the refrigerant path is alternatingly compressed by the compressor and expanded by the expansion device. Heat exchange takes place in the heat rejecting heat exchanger and the evaporator in such a manner that heat is rejected from the refrigerant flowing through the heat rejecting heat exchanger, and heat is absorbed by the refrigerant flowing through the evaporator. Thereby the refrigeration system may be used for providing either heating or cooling.

In some refrigeration systems an ejector is arranged in the refrigerant path between the heat rejecting heat exchanger and the expansion device. An ejector is a type of pump which uses the Venturi effect to increase the pressure energy of fluid at a suction inlet of the ejector by means of a motive fluid supplied to a motive inlet of the ejector. Thereby, arranging an ejector in the refrigerant path as described will cause the refrigerant to perform work, and thereby the power consumption of the refrigeration system is reduced as compared to the situation where no ejector is provided. However, this may cause the pressure of refrigerant leaving the heat rejecting heat exchanger to decrease to an undesired low level.

U.S. 2012/0167601 A1 discloses a system having a compressor. A heat rejecting heat exchanger is coupled to the compressor to receive compressed refrigerant. An ejector has a primary inlet coupled to the heat rejecting heat exchanger to receive refrigerant, a secondary inlet and an outlet. In one mode refrigerant passes from the heat rejecting heat exchanger, through the ejector primary inlet and out the ejector outlet to a separator. In a second mode refrigerant passes from the heat rejecting heat exchanger to the separator.

SUMMARY

It is an object of embodiments of the invention to provide a method for controlling a capacity of a variable capacity ejector unit in a simple manner.

It is a further object of embodiments of the invention to provide a method for controlling a capacity of a variable capacity ejector unit in a refrigeration system, the method allowing a low power consumption of the refrigeration system while maintaining a desired pressure level in a high pressure part of the refrigeration system.

According to a first aspect the invention provides a method for controlling a variable capacity ejector unit arranged in a refrigeration system, said refrigeration system further comprising a compressor, a heat rejecting heat exchanger, an expansion device and an evaporator arranged in a refrigerant path, wherein the ejector unit is fluidly connected in the refrigerant path between the heat rejecting heat exchanger and the expansion device, the method comprising the steps of:

- obtaining a temperature and a pressure of refrigerant leaving the heat rejecting heat exchanger,
- generating an ejector control signal for the ejector unit, based on the obtained temperature and the obtained pressure, said ejector control signal indicating whether the capacity of the ejector unit should be increased, decreased or maintained, and
- controlling the capacity of the ejector unit in accordance with the generated ejector control signal.

The invention relates to a method for controlling a variable capacity ejector unit, more specifically for controlling the capacity of the variable capacity ejector unit. The ejector unit is arranged in, or forms part of, a refrigeration system. In the present context the term 'refrigeration system' should be interpreted to mean any system in which a flow of fluid medium, such as refrigerant, circulates and is alternatingly compressed and expanded, thereby providing either refrigeration or heating of a volume. Thus, the refrigeration system may be a cooling system, a freezing system, an air condition system, a heat pump, etc.

The refrigeration system further comprises a compressor, a heat rejecting heat exchanger, an expansion device, e.g. in the form of an expansion valve, and an evaporator arranged in a refrigerant path. Refrigerant flowing in the refrigerant path is compressed in the compressor. The compressed refrigerant is supplied to the heat rejecting heat exchanger, where heat is rejected from the refrigerant to the surroundings, e.g. in the form of a secondary fluid flow across the heat rejecting heat exchanger. Refrigerant leaving the heat rejecting heat exchanger passes through the ejector unit, or possibly through a parallel flow path, to the expansion device. In the expansion device, the refrigerant is expanded before it enters the evaporator. In the evaporator the liquid part of the refrigerant is at least partly evaporated, while heat is absorbed by the refrigerant from the surroundings, e.g. in the form of a secondary fluid flow across the evaporator. Finally, the refrigerant is supplied to the compressor, and is once again compressed. Thus, the refrigerant flowing in the refrigerant path is alternatingly compressed by the compressor and expanded by the expansion device, and heat exchange takes place in the heat rejecting heat exchanger and the evaporator. The refrigeration system may provide heating for a closed volume, due to the heat exchange taking place in the heat rejecting heat exchanger, and/or the refrigeration system may provide cooling for a closed volume, due to the heat exchange taking place in the evaporator.

The heat rejecting heat exchanger may, e.g., be in the form of a condenser, in which refrigerant passing through the heat rejecting heat exchanger is at least partly condensed, or in the form of a gas cooler, in which refrigerant passing through the condenser is cooled, but remains in a gaseous form, i.e. no phase change takes place. Gas coolers are mainly used in refrigeration systems in which a transcritical refrigerant, such as $CO_2$, is applied.

The ejector unit may comprise two or more ejectors arranged fluidly in parallel in the refrigerant path. In this case the capacity of the ejector unit may be adjusted by activating or deactivating the individual ejectors. Alternatively or additionally, the ejector unit may comprise one or more ejectors having a variable capacity. In this case the capacity of the ejector unit may be adjusted by adjusting the capacity of such ejector(s). In any event, the ejector unit is of a kind where the capacity of the ejector unit, i.e. the amount of refrigerant passing through the ejector unit, is variable, i.e. it is possible to adjust the capacity of the ejector unit.

According to the method of the first aspect of the invention, a temperature and a pressure of refrigerant leaving the heat rejecting heat exchanger are initially obtained. This may include measuring the temperature and/or the pressure of the refrigerant directly. As an alternative, the temperature and/or the pressure may be derived from other measured parameters relating to the refrigerant.

Based on the obtained temperature and the obtained pressure, an ejector control signal for the ejector unit is generated. The ejector control signal indicates whether the capacity of the ejector unit should be increased, decreased or maintained. In the latter case it is determined that the current capacity of the ejector unit matches the current operating conditions, and that there is therefore no need to adjust the capacity.

Finally, the capacity of the ejector unit is controlled in accordance with the generated ejector control signal. Thus, in the case that the ejector control signal indicates that the capacity of the ejector unit should be increased, then the capacity of the ejector unit is increased accordingly. In the case that the ejector control signal indicates that the capacity of the ejector unit should be decreased, then the capacity of the ejector unit is decreased accordingly. Finally, in the case that the ejector control signal indicates that the capacity of the ejector unit should be maintained, then no adjustments are made to the capacity of the ejector unit, and the current capacity is maintained. The ejector control signal may further indicate how much the capacity of the ejector unit should be increased or decreased. In this case the adjustment of the capacity of the ejector unit is performed in accordance therewith.

Accordingly, the capacity of the ejector unit, and thereby the flow of refrigerant through the ejector unit, is controlled on the basis of the temperature and the pressure of refrigerant leaving the heat rejecting heat exchanger. Thereby it is ensured that the capacity of the ejector unit is selected in such a manner that an appropriate pressure level, under the given operating conditions, is maintained in the refrigerant leaving the heat rejecting heat exchanger. Simultaneously, it is ensured that the refrigerant flow through the ejector unit is as high as possible. Thereby it is ensured that a large portion of the refrigerant flowing from the heat rejecting heat exchanger towards the expansion device performs work, and thereby the power consumption of the refrigeration system is minimised. Furthermore, this is obtained without risking that the pressure of the refrigerant leaving the heat rejecting heat exchanger decreases below an acceptable level. Finally, the control of the capacity of the ejector unit is performed in a very easy and simple manner, similar to the way a normal valve could be controlled.

The step of generating an ejector control signal may comprise the steps of:

calculating a reference pressure value on the basis of the obtained temperature, comparing the calculated reference pressure value to the obtained pressure, and generating the ejector control signal based on said comparison.

The calculated reference pressure value corresponds to a pressure level of the refrigerant leaving the heat rejecting heat exchanger, which is appropriate under the given operating condition, notably given the current temperature of the refrigerant leaving the heat rejecting heat exchanger. The reference pressure is then compared to the obtained pressure of refrigerant leaving the heat rejecting heat exchanger, i.e. to the pressure which is actually prevailing in the refrigerant leaving the heat rejecting heat exchanger, and the ejector control signal is generated based on the comparison. It is desirable that the actual pressure is equal to the reference pressure value, because the reference pressure value represents the optimal pressure under the given circumstances. Accordingly, the ejector control signal is generated in a manner which ensures that the pressure of the refrigerant leaving the heat rejecting heat exchanger approaches the calculated pressure value in the case that the comparison reveals that there is a mismatch between the calculated reference pressure value and the obtained pressure.

The refrigeration system may further comprise a high pressure valve arranged in the refrigerant path, fluidly in parallel with the ejector unit, between the heat rejecting heat exchanger and the expansion device, and the method may further comprise the steps of:

generating a high pressure valve control signal for the high pressure valve on the basis of the obtained temperature and the obtained pressure, and controlling an opening degree of the high pressure valve in accordance with the high pressure valve control signal, wherein the ejector control signal is generated on the basis of the high pressure valve control signal.

According to this embodiment, the refrigeration system comprises two parallel flow paths between the heat rejecting heat exchanger and the expansion device, i.e. a flow path passing through the ejector unit and a flow path passing through the high pressure valve. Thereby the refrigerant flowing from the heat rejecting heat exchanger to the expansion device can be divided into a portion passing through the ejector unit and a portion passing through the high pressure valve. As described above, it is desirable that as large a portion of the fluid flow as possible passes through the ejector unit.

For instance, the capacity of the ejector unit may be variable between a number of discrete capacity levels. In this case it may not be possible to select a capacity level of the ejector unit which exactly matches a required fluid flow from the heat rejecting heat exchanger to the expansion device. In this case the highest capacity level which is lower than the required fluid flow is selected, and the high pressure valve is controlled to have an opening degree which ensures that the required fluid flow is reached.

According to this embodiment, a high pressure valve control signal for the high pressure valve is generated on the basis of the obtained temperature and the obtained pressure, and the opening degree of the high pressure valve is controlled in accordance with the high pressure valve control signal. Thus, the high pressure valve, in particular an opening degree of the high pressure valve, is controlled on the basis of the temperature and the pressure of refrigerant leaving the heat rejecting heat exchanger, and possibly independently of the control of the ejector unit.

Furthermore, the high pressure valve control signal is used as an input for generating the ejector control signal. Thus, according to this embodiment, the ejector control signal is only indirectly based on the obtained temperature and the obtained pressure, in the sense that the obtained temperature and the obtained pressure are used for generating the high pressure valve control signal, which is in turn used for generating the ejector control signal. For instance, the high pressure valve control signal and the ejector control signal may be generated by separate controllers, and the output of the high pressure valve controller may be used as an input for the ejector controller.

The step of generating the ejector control signal may comprise comparing the high pressure valve control signal to an upper limit value and a lower limit value, the lower limit value being lower than the upper limit value, and increasing the capacity of the ejector unit in the case that the high pressure valve control signal is higher than the upper limit value, decreasing the capacity of the ejector unit in the case that the high pressure valve control signal is lower than the lower limit value, and maintaining the capacity of the ejector unit in the case that the high pressure valve control signal is higher than the lower limit value and lower than the upper limit value.

In the case that the high pressure valve control signal indicates that the high pressure valve should be controlled to a relatively high opening degree, this is an indication that it is possible to allow a larger portion of the refrigerant to pass through the ejector unit without risking that the pressure of the refrigerant leaving the heat rejecting heat exchanger decreases to an undesirable level. Therefore, in this case the capacity of the ejector unit can advantageously be increased.

Similarly, in the case that the high pressure valve control signal indicates that the high pressure valve should be controlled to a relatively low opening degree, this is an indication that a too large portion of the refrigerant is passed through the ejector unit, and that there is therefore a risk that the pressure of the refrigerant leaving the heat rejecting heat exchanger decreases to an undesired level. Therefore, in this case the capacity of the ejector unit is decreased in order to prevent that the undesired pressure level is reached.

Finally, in the case that the high pressure valve control signal indicates that the high pressure valve should be controlled to an opening degree within a predefined acceptable range, this is an indication that the portion of refrigerant passing through the ejector unit matches the current operating conditions. Therefore, in this case the capacity of the ejector unit is maintained.

When the capacity of the ejector unit is adjusted, the pressure of the refrigerant leaving the heat rejecting heat exchanger is affected. Since the high pressure valve control signal is generated based on the pressure of the refrigerant leaving the heat rejecting heat exchanger, the high pressure valve control signal is thereby also affected. And this will, in turn, affect the ejector control signal, since the ejector control signal is generated based on the high pressure valve control signal.

The capacity of the ejector unit may only be increased or decreased if the high pressure valve control signal has been higher than the upper limit value or lower than the lower limit value for a predefined time interval. According to this embodiment, it is ensured that the capacity of the ejector unit is only increased or decreased if the high pressure valve control signal is truly above or below the respective upper or lower limit values, and the capacity of the ejector unit is not adjusted if the high pressure valve control signal is only briefly above or below the limit values. Thereby it is avoided that the ejector unit is repeatedly switched between capacity levels, and wear on the ejector unit is thereby reduced.

The ejector unit may comprise a valve, such as a solenoid valve, arranged in front of each of the ejectors of the ejector unit. In this case, an ejector may be activated by opening the corresponding valve, and an ejector may be deactivated by closing the corresponding valve. According to this embodiment, wear on the ejector unit due to repeatedly switching between capacity levels mainly includes wear on the valves.

The method may further comprise the steps of:

generating a feed forward signal based on the ejector control signal, said feed forward signal indicating whether the capacity of the ejector unit has been increased, decreased or maintained, and adjusting the high pressure valve control signal on the basis of the feed forward signal.

As described above, the pressure of the refrigerant leaving the heat rejecting heat exchanger is affected when the capacity of the ejector unit is adjusted. The opening degree of the high pressure valve must be adjusted in response thereto. This will occur automatically when the high pressure valve control signal is generated based on the obtained pressure and the obtained temperature. However, the adjustment of the opening degree of the high pressure valve will occur with a delay. By generating a feed forward signal as described above, the high pressure valve control signal can be immediately adjusted to respond to the expected pressure changes resulting from the adjustment of the capacity of the ejector unit.

According to an alternative embodiment, the capacity of the ejector unit may be continuously adjustable. Thereby the refrigerant flow from the heat rejecting heat exchanger to the expansion device can be controlled by controlling the capacity of the ejector unit alone. Thereby a high pressure valve arranged fluidly in parallel with the ejector unit is not required.

The ejector unit may comprise two or more ejectors arranged fluidly in parallel in the refrigerant path, and the step of controlling the capacity of the ejector unit in accordance with the generated ejector control signal may comprise activating or deactivating one or more of the ejectors. According to this embodiment, the variable capacity of the ejector unit is provided by the two or more ejectors being arranged fluidly in parallel. The capacity of the ejector unit can thereby be adjusted between discrete capacity levels, defined by the capacities of the individual ejectors.

The ejectors may be identical, in the sense that they provide the same capacity. In this case the capacity of the ejector unit is adjustable between equidistant capacity levels, the distance between two adjacent capacity levels corresponding to the capacity of one of the ejectors. As an alternative, the ejectors may provide different capacities. In this case it must be selected carefully which ejectors to activate or deactivate in order to obtain a given capacity level of the ejector unit.

The two or more ejectors may be arranged in an ejector block. As an alternative, the ejectors may simply be mounted in a parallel manner in the refrigerant path.

According to an alternative embodiment, the ejector unit may comprise at least one variable capacity ejector, and the step of controlling the capacity of the ejector unit in accordance with the generated ejector control signal may comprise adjusting the capacity of the variable capacity ejector.

According to this embodiment, the capacity of the ejector block is continuously adjustable.

According to a second aspect the invention provides a method for controlling a variable capacity ejector unit arranged in a refrigeration system, said refrigeration system further comprising a compressor, a heat rejecting heat exchanger, a high pressure valve, an expansion device and an evaporator arranged in a refrigerant path, wherein the ejector unit is fluidly connected in the refrigerant path between the heat rejecting heat exchanger and the expansion device, fluidly in parallel with the high pressure valve, the method comprising the steps of:

generating a high pressure valve control signal for the high pressure valve, and controlling an opening degree of the high pressure valve in accordance with the high pressure valve control signal, monitoring the high pressure valve control signal, generating an ejector control signal for the ejector unit, based on the high pressure valve control signal, said ejector control signal indicating whether the capacity of the ejector unit should be increased, decreased or maintained, and controlling the capacity of the ejector unit in accordance with the generated ejector control signal.

It should be noted that a person skilled in the art would readily recognise that any feature described in combination with the first aspect of the invention could also be combined with the second aspect of the invention, and vice versa. The remarks set forth above are therefore equally applicable here.

According to the second aspect of the invention, a high pressure valve is arranged in the refrigerant path between the heat rejecting heat exchanger and the expansion device, and fluidly in parallel with the ejector unit. Thus, the refrigerant leaving the heat rejecting heat exchanger may either pass through the high pressure valve or through the ejector unit. This has already been described above.

An opening degree of the high pressure valve is controlled in accordance with a generated high pressure valve control signal. The high pressure valve control signal may be generated in any suitable manner. It could, e.g., be generated on the basis of the pressure and/or the temperature of refrigerant leaving the heat rejecting heat exchanger, as described above, but alternative approaches could also be applied.

The high pressure valve control signal is monitored, and an ejector control signal for the ejector unit is generated, based on the high pressure valve control signal. The ejector control signal indicates whether the capacity of the ejector unit should be increased, decreased or maintained. Finally, the capacity of the ejector unit is controlled on the basis of the generated ejector control signal.

The high pressure valve control signal provides information regarding the opening degree of the high pressure valve. Thereby it also provides information regarding the amount of refrigerant passing through the high pressure valve instead of passing through the ejector unit. Accordingly, the high pressure valve control signal, regardless of how it is generated, forms an appropriate basis for determining whether or not more or less refrigerant should be passed through the ejector unit, and thereby it forms an appropriate input for generating the ejector control signal.

The step of generating the ejector control signal may comprise comparing the high pressure valve control signal to an upper limit value and a lower limit value, the lower limit value being lower than the upper limit value, and increasing the capacity of the ejector unit in the case that the high pressure valve control signal is higher than the upper limit value, decreasing the capacity of the ejector unit in the case that the high pressure valve control signal is lower than the lower limit value, and maintaining the capacity of the ejector unit in the case that the high pressure valve control signal is higher than the lower limit value and lower than the upper limit value.

As described above with reference to the first aspect of the invention, a high opening degree of the high pressure valve indicates that a large portion of the refrigerant passes through the high pressure valve, and that the capacity of the ejector unit may therefore advantageously be increased. Similarly, a low opening degree of the high pressure valve indicates that a small portion of the refrigerant passes through the high pressure valve, and that the portion of the refrigerant passing through the ejector unit may therefore be too large. Accordingly, the capacity of the ejector unit is decreased in this case. The remarks set forth above in this regard with reference to the first aspect of the invention are equally applicable here.

The capacity of the ejector unit may only be increased or decreased if the high pressure valve control signal has been higher than the upper limit value or lower than the lower limit value for a predefined time interval. This has already been described above with reference to the first aspect of the invention, and the remarks set forth in this regard are equally applicable here.

The method may further comprise the steps of:

generating a feed forward signal based on the ejector control signal, said feed forward signal indicating whether the capacity of the ejector unit has been increased, decreased or maintained, and adjusting the high pressure valve control signal on the basis of the feed forward signal.

This has also been described above with reference to the first aspect of the invention, and the remarks set forth in this regard are equally applicable here.

BRIEF DESCRIPTION OF THE DRAWINGS

The invention will now be described in further detail with reference to the accompanying drawings in which.

DETAILED DESCRIPTION

Figure 1:
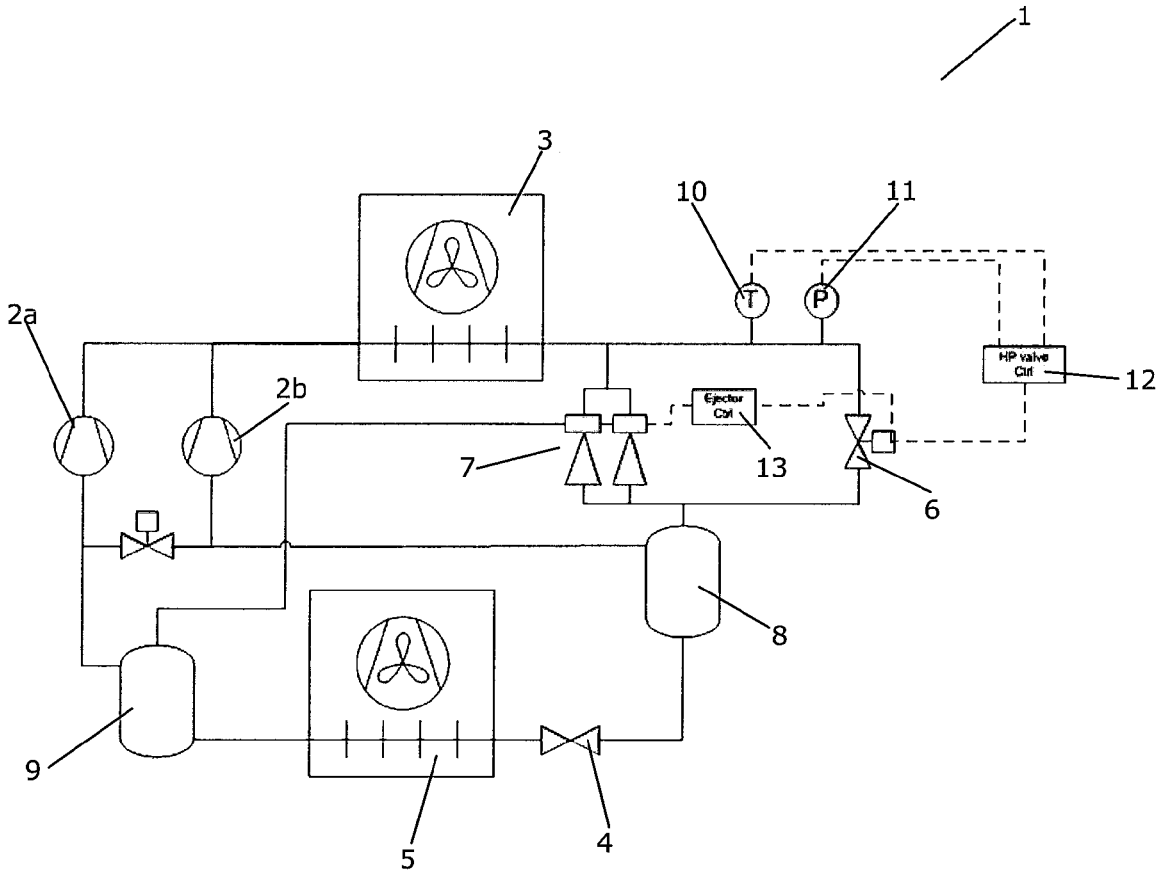
FIG. 1 is a diagrammatic view of a refrigeration system comprising a variable capacity ejector unit being controlled using a method according to an embodiment of the invention.

FIG. 1 is a diagrammatic view of a refrigeration system 1. The refrigeration system 1 comprises a compressor 2, a heat rejecting heat exchanger 3, an expansion device 4, in the form of an expansion valve, and an evaporator 5 arranged in a refrigerant path. A high pressure valve 6 and an ejector unit 7 are arranged fluidly in parallel in the refrigerant path between the heat rejecting heat exchanger 3 and the expansion device 4. In FIG. 1 the ejector unit 7 is illustrated as comprising two ejectors arranged fluidly in parallel, each ejector having a valve, such as a solenoid valve, arranged in front of the ejector, and the ejectors are activated and deactivated by opening and closing the corresponding valves. However, the ejector unit 7 could, alternatively, be of a kind comprising a single ejector having a variable capacity. In any event, the capacity of the ejector unit 7 is variable. The compressor 2 comprises two compressors 2*a*, 2*b* arranged in parallel. This will be described in further detail below.

Refrigerant flowing in the refrigerant path is compressed in the compressor 2. The compressed refrigerant is supplied to the heat rejecting heat exchanger 3, where heat exchange takes place with the ambient in such a manner that heat is rejected from the refrigerant flowing in the heat rejecting heat exchanger 3.

The refrigerant leaving the heat rejecting heat exchanger 3 passes through either the ejector unit 7 or the high pressure valve 6 to a receiver 8. From the receiver 8 the gaseous part of the refrigerant is supplied directly to compressor 2*b*, thereby bypassing the expansion device 4 and the evaporator 5. The refrigerant being supplied to compressor 2*b* thereby has a relatively high pressure, and the work required by the compressor 2*b* is minimised.

The liquid part of the refrigerant leaving the receiver 8 is supplied to the expansion device 4, where it is expanded before being supplied to the evaporator 5. In the evaporator 5, heat exchange takes place with the ambient in such a manner that heat is absorbed by the refrigerant flowing in the evaporator 5, while the liquid part of the refrigerant is at least partly evaporated.

Refrigerant leaving the evaporator 5 is supplied to a separator 9, where the refrigerant is separated into a liquid part and a gaseous part. The gaseous part of the refrigerant is supplied to compressor 2*a*, where it is once again compressed. The liquid part of the refrigerant is returned to the ejector unit 7, where it constitutes a suction fluid which is mixed with a motive fluid, in the form of the refrigerant supplied from the heat rejecting heat exchanger 3 to the ejector unit 7. The high pressure motive fluid sucks the suction fluid, having a lower pressure, through a suction nozzle in the ejector.

A temperature sensor 10 and a pressure sensor 11 are arranged to measure the temperature and the pressure, respectively, of refrigerant leaving the heat rejecting heat exchanger 3. The signals measured by the temperature sensor 10 and the pressure sensor 11 are supplied to a high pressure valve controller 12. Based on the received signals, the high pressure valve controller 12 generates a high pressure valve control signal, specifying an opening degree of the high pressure valve 6. The generated high pressure valve control signal is supplied to the high pressure valve 6, and the opening degree of the high pressure valve 6 is controlled in accordance therewith.

Since the high pressure control signal is generated on the basis of the measured temperature and pressure of the refrigerant leaving the heat rejecting heat exchanger 3, the opening degree of the high pressure valve 6 is controlled in accordance with these parameters, and thereby the opening degree of the high pressure valve 6 is controlled in such a manner that an appropriate pressure level of the refrigerant leaving the heat rejecting heat exchanger 3 is obtained. In particular, it is ensured that the pressure does not reach an undesired low level.

The high pressure valve control signal is further supplied to an ejector controller 13. Based on the received high pressure control signal, the ejector controller 13 generates an ejector control signal, specifying a capacity level of the ejector unit 7. The generated ejector control signal is supplied to the ejector unit 7, and the capacity of the ejector unit 7 is controlled in accordance therewith. In the embodiment illustrated in FIG. 1, the capacity of the ejector unit 7 is adjusted by activating or deactivating one of the ejectors of the ejector unit 7, e.g. by opening or closing one of the valves arranged in front of the ejector units.

In the case that the high pressure valve control signal indicates that the opening degree of the high pressure valve 6 is relatively high, this is an indication that a large amount of refrigerant needs to be passed through the high pressure valve 6, at the current capacity of the ejector unit 7, in order to obtain a desired pressure level of the refrigerant leaving the heat rejecting heat exchanger 3. It may therefore be concluded that a larger amount of refrigerant could be passed through the ejector unit 7, without risking that the pressure of the refrigerant leaving the heat rejecting heat exchanger 3 decreases to an undesired level. Therefore, in this situation an ejector control signal is generated which indicates that the capacity of the ejector unit 7 shall be increased.

In the case that the high pressure valve control signal indicates that the opening degree of the high pressure valve 6 is relatively low, this is an indication that, at the current capacity of the ejector unit 7, it is necessary to keep the refrigerant flow through the high pressure valve 6 at a very low level in order to obtain an acceptable pressure level of the refrigerant leaving the heat rejecting heat exchanger 3. It may therefore be concluded that the amount of refrigerant passing through the ejector unit 7 is too large. Therefore, in this situation an ejector control signal is generated which indicates that the capacity of the ejector unit 7 shall be decreased.

In the case that the high pressure valve control signal indicates that the opening degree of the high pressure valve 6 is within an acceptable, predefined range, this is an indication that an acceptable pressure level of the refrigerant leaving the heat rejecting heat exchanger 3 can be obtained, at the current capacity of the ejector unit 7, with a reasonable amount of refrigerant passing through the high pressure valve 6. Therefore, in this situation an ejector control signal is generated which indicates that the current capacity of the ejector unit 7 shall be maintained.

Thus, the capacity of the ejector unit 7 is controlled on the basis of the high pressure valve control signal. Furthermore, the capacity of the ejector unit 7 is controlled in such a manner that as large a portion as possible of the refrigerant is passed through the ejector unit 7, rather than through the high pressure valve 6, while ensuring that the pressure of the refrigerant leaving the heat rejecting heat exchanger 3 does not decrease to an undesired level. Accordingly, the power consumption of the refrigeration system is reduced.

Figure 2:
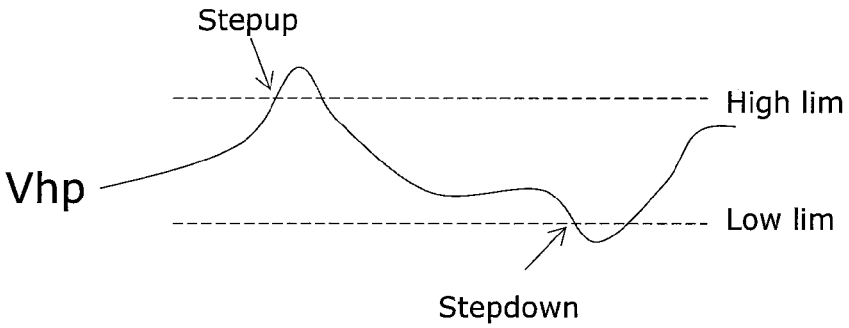
FIG. 2 is a graph illustrating control of a variable capacity ejector unit in accordance with a method according to an embodiment of the invention.

FIG. 2 is a graph illustrating control of a variable capacity ejector unit in accordance with a method according to an embodiment of the invention. The variable capacity ejector unit may, e.g., be the variable capacity ejector unit illustrated in FIG. 1. In the method according to this embodiment, the capacity of the ejector unit is controlled on the basis of a high pressure valve control signal.

The curve represents the opening degree of the high pressure valve, and may be derived from the high pressure valve control signal. A lower limit value (Low lim) and an upper limit value (High lim) are shown. The lower limit value represents an opening degree of the high pressure valve, which is so low that there is a risk that the pressure of the refrigerant leaving the heat rejecting heat exchanger decreases to an undesirable level. The upper limit value represents an opening degree of the high pressure valve, which is sufficiently high to allow a larger portion of the refrigerant leaving the heat rejecting heat exchanger to pass through the ejector unit instead of through the high pressure valve.

The graph of FIG. 2 illustrates that when the opening degree of the high pressure valve reaches the upper limit value, then the capacity of the ejector unit is increased (stepup). This causes the pressure of the refrigerant leaving the heat rejecting heat exchanger to decrease, and in response thereto, the opening degree of the high pressure valve is also decreased.

When the opening degree of the high pressure valve reached the lower limit value, then the capacity of the ejector unit is decreased (stepdown). This causes the pressure of the refrigerant leaving the heat rejecting heat exchanger to increase, and in response thereto, the opening degree of the high pressure valve is also increased.

As long as the opening degree of the high pressure valve remains between the lower limit value and the upper limit value, the capacity of the ejector unit is maintained at the current level.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A method for controlling a variable capacity ejector unit arranged in a refrigeration system, said refrigeration system further comprising a compressor, a heat rejecting heat exchanger, an expansion device, an evaporator and a high pressure valve arranged in a refrigerant path, wherein the ejector unit is fluidly connected in the refrigerant path between the heat rejecting heat exchanger and the expansion device, wherein the high pressure valve is fluidly connected in the refrigerant path in parallel with the ejector unit, between the heat rejecting heat exchanger and the expansion device, the method comprising the steps of:

obtaining a temperature and a pressure of refrigerant leaving the heat rejecting heat exchanger, generating a high pressure valve control signal for the high pressure valve on the basis of the obtained temperature and the obtained pressure, supplying the high pressure valve control signal to an ejector controller, generating, by the ejector controller, an ejector control signal for the ejector unit based on the high pressure control valve signal, said ejector control signal indicating whether the capacity of the ejector unit should be increased, decreased or maintained, controlling the capacity of the ejector unit in accordance with the generated ejector control signal, and controlling an opening degree of the high pressure valve in accordance with the high pressure valve control signal.

2. The method according to claim 1, wherein the step of generating an ejector control signal comprises the steps of:

calculating a reference pressure value on the basis of the obtained temperature, comparing the calculated reference pressure value to the obtained pressure, and generating the ejector control signal based on said comparison.

3. The method according to claim 1, wherein the step of generating the ejector control signal comprises comparing the high pressure valve control signal to an upper limit value and a lower limit value, the lower limit value being lower than the upper limit value, and increasing the capacity of the ejector unit in the case that the high pressure valve control signal is higher than the upper limit value, decreasing the capacity of the ejector unit in the case that the high pressure valve control signal is lower than the lower limit value, and maintaining the capacity of the ejector unit in the case that the high pressure valve control signal is higher than the lower limit value and lower than the upper limit value.

4. The method according to claim 3, wherein the capacity of the ejector unit is only increased or decreased if the high pressure valve control signal has been higher than the upper limit value or lower than the lower limit value for a predefined time interval.

5. The method according to claim 1, further comprising the steps of:

generating a feed forward signal based on the ejector control signal, said feed forward signal indicating whether the capacity of the ejector unit has been increased, decreased or maintained, and adjusting the high pressure valve control signal on the basis of the feed forward signal.

6. The method according to claim 1, wherein the ejector unit comprises two or more ejectors arranged fluidly in parallel in the refrigerant path, and wherein the step of controlling the capacity of the ejector unit in accordance with the generated ejector control signal comprises activating or deactivating one or more of the ejectors.

7. The method according to claim 6, wherein the two or more ejectors are arranged in an ejector block.

8. The method according to claim 1, wherein the ejector unit comprises at least one variable capacity ejector, and wherein the step of controlling the capacity of the ejector unit in accordance with the generated ejector control signal comprises adjusting the capacity of the variable capacity ejector.

9. The method according to claim 3, further comprising the steps of:

generating a feed forward signal based on the ejector control signal, said feed forward signal indicating whether the capacity of the ejector unit has been increased, decreased or maintained, and adjusting the high pressure valve control signal on the basis of the feed forward signal.

10. The method according to claim 4, further comprising the steps of:

generating a feed forward signal based on the ejector control signal, said feed forward signal indicating whether the capacity of the ejector unit has been increased, decreased or maintained, and adjusting the high pressure valve control signal on the basis of the feed forward signal.

11. The method according to claim 2, wherein the ejector unit comprises two or more ejectors arranged fluidly in parallel in the refrigerant path, and wherein the step of controlling the capacity of the ejector unit in accordance with the generated ejector control signal comprises activating or deactivating one or more of the ejectors.

12. The method according to claim 3, wherein the ejector unit comprises two or more ejectors arranged fluidly in parallel in the refrigerant path, and wherein the step of controlling the capacity of the ejector unit in accordance with the generated ejector control signal comprises activating or deactivating one or more of the ejectors.

13. The method according to claim 4, wherein the ejector unit comprises two or more ejectors arranged fluidly in parallel in the refrigerant path, and wherein the step of controlling the capacity of the ejector unit in accordance with the generated ejector control signal comprises activating or deactivating one or more of the ejectors.

* * * * *